United States Patent [19]

Edwards

[11] 4,353,075

[45] Oct. 5, 1982

[54] TELESCOPING VEHICLE RADIO ANTENNA WITH COMPRESSIBLE O-RING SEAL

[75] Inventor: Ralph W. Edwards, Dayton, Ohio

[73] Assignee: General Motors Corporation, Detroit, Mich.

[21] Appl. No.: 252,599

[22] Filed: Apr. 9, 1981

[51] Int. Cl.[3] ..... H01Q 1/10

[52] U.S. Cl. ..... 343/903; 343/901

[58] Field of Search ..... 343/902, 901, 903, 900, 343/711–715

[56] References Cited

U.S. PATENT DOCUMENTS

| | | | |
|---|---|---|---|
| 2,172,117 | 9/1939 | Beaufort et al. | 343/902 |
| 2,173,095 | 9/1939 | Byrne | 343/902 |
| 2,593,432 | 4/1952 | Freas | 343/902 |
| 3,253,799 | 5/1966 | Till | 242/77 |
| 3,929,357 | 12/1975 | De Vincent et al. | 285/319 |
| 4,062,156 | 12/1977 | Roth | 343/903 |

*Primary Examiner*—David K. Moore

*Attorney, Agent, or Firm*—Robert M. Sigler

[57] ABSTRACT

A telescoping, multi-tube, vehicle radio antenna adapted for power extension and retraction includes an outer metallic tube having inward bent upper end defining an inner annular bearing surface and an inner metallic cylindrical member in telescoping relationship within the outer tube, the cylindrical member having an expanded diameter rigid lower end which defines an outer annular bearing surface and further being slidably supported in the first tube by the axially separated bearing surfaces. The cylindrical member further has a circumferential shoulder spaced upwardly from its lower end and a circumferential sealing element carried on the upper side of the shoulder for compression between the shoulder and the inward bent upper end of the outer tube when the antenna is extended to prevent the entry of water into the antenna interior. The sealing element thus separates from the outer tube and contributes no sliding friction during the antenna extension and retraction.

1 Claim, 2 Drawing Figures

TELESCOPING VEHICLE RADIO ANTENNA WITH COMPRESSIBLE O-RING SEAL

BACKGROUND OF THE INVENTION

This invention relates to telescoping, multi-tube, vehicle radio antennas adapted for power extension and retraction, and particularly such antennas having sealing means between telescoping tubes to prevent the entry of water into the interior of the antenna. Such sealing means may be desirable when the antenna is mounted in a part of the vehicle which does not provide a drain for the antenna, such as certain rear fenders adjacent the vehicle trunk.

Prior art antennas of this kind often have used an annular sealing element in or adjacent the upper opening of each tube to maintain sealing contact with the tube just inside it as the latter moved axially through said opening. However, a problem which can occur with such antennas is a tendency of two or more of said tubes to bind against each other in a partially extended position and thus prevent full extension or closure of the antenna, particularly in freezing wet weather. The friction of a sealing element throughout the entire antenna extension and retraction can aggravate such a problem.

SUMMARY OF THE INVENTION

It is, therefore, an object of this invention to provide a telescoping, multi-tube, vehicle radio antenna adapted for power extension and retraction which includes sealing means effective to prevent the entry of water into the interior of the antenna but with substantially no friction caused by said sealing means during extension and retraction of the antenna.

This object is attained in an antenna having an outer metallic antenna tube with an inward bent upper end defining an inner annular bearing surface and an inner metallic cylindrical antenna member in telescoping relationship within the tube with an expanded diameter rigid lower end defining an outer annular bearing surface, the tube and cylindrical member slidably engaged only at the axially spaced annular bearing surfaces. The cylindrical member has a circumferential shoulder spaced upwardly from the lower end and a circumferential sealing element abutting the upper side of the circumferential shoulder. This sealing element becomes compressed between the circumferential shoulder and the inward bent upper end of the metallic tube when the antenna is extended to provide sealing between the tubes; however, it is carried by the cylindrical member out of engagement with the tube for substantially no friction therebetween during extension and retraction of the antenna. Although this provides less secure sealing between the tube and cylindrical member during extension and retraction of the antenna, a close fit between the inner annular bearing surface of the tube and the outer surface of the cylindrical member combined with the short time duration of such extensions and retractions prevent any substantial entry of water into the interior of the antenna. A standard cap mounted on the top of the innermost antenna cylindrical member to cover the entire apparatus when the antenna is fully retracted prevents the entry of water during that condition of the antenna.

Further details and advantages of this invention will be apparent from the accompanying drawings and following description of a preferred embodiment.

DESCRIPTION OF THE PREFERRED EMBODIMENT

Figure 1:
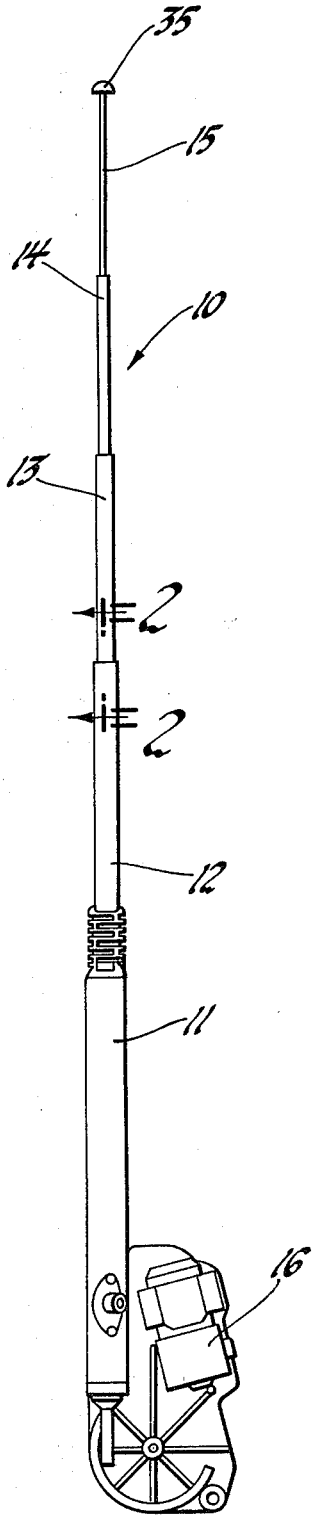
FIG. 1 shows an elevational view of an antenna according to this invention.

Referring to FIG. 1, a multi-tube, telescoping, power actuated vehicle radio antenna 10 includes a plurality of tubes 11, 12, 13 and 14 and a rod 15 of decreasing diameter which are nested in telescoping relationship, each within the preceding, and adapted for power extension and retraction by standard motor and cable actuator means 16 at the bottom thereof. The outer member of each nested pair is a tube with the inner member being a cylindrical member which can be a tube or a rod.

The antenna is adapted for mounting within the fender or other sheet metal of a motor vehicle with the top of the outermost tube 11 disposed in an opening in the fender or other outer vehicle surface to allow extension of the other antenna elements out of the vehicle body for radio reception and retraction of the other antenna elements back within the vehicle body for prevention of damage thereto when the radio is not being operated. Apparatus and arrangements for mounting such antennas in motor vehicles and driving the antenna elements in extension and retraction are well known in the prior art and will not be discussed herein except to the extent that changes are required in the antenna of this invention.

Figure 2:
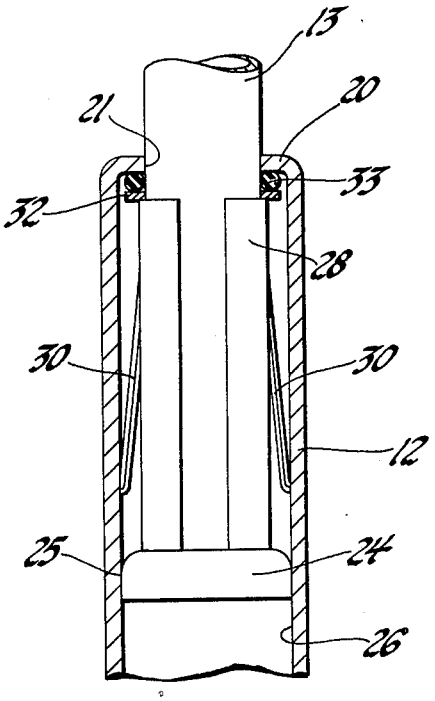
FIG. 2 provides a sectional view along lines 2—2 of the antenna of FIG. 1.

FIG. 2 shows a cutaway view of portions of tubes 12 and 13 in the antenna of FIG. 1. Tube 12 is made from an electrically conducting material such as brass with a chrome plating and is provided with a bent inward upper end 20 defining an inner annular bearing surface 21. The diameter of inner annular bearing surface 21 is just larger than the outer diameter of tube 13 so that it can serve as a bearing for tube 13 as tube 13 moves axially through tube 12. A preferred way of constructing tube 12 with bent inward upper end 20 is to bend in the upper end 20 by standard metal forming techniques to create a circular opening smaller than the required, then chrome plate tube 12, and finally bore or remount the opening to the exact diameter required. The last step has the further advantage of removing the chrome plating from inner annular bearing surface 21 to expose the brass for good sliding bearing contact with the chrome plated outer surface of tube 13. A minimal clearance between inner annular bearing surface 21 and tube 13 helps ensure a strong, tight extended antenna as well as minimal leakage of water into the interior of the antenna during extension and retraction.

Inner cylindrical member or tube 13 has an expanded diameter rigid lower end 24 defining an outer annular bearing surface 25 effective to slidably engage the inner surface 26 of tube 12. The chrome plating is removed from outer annular surface 25 to ensure a good sliding bearing relationship between that surface and tube 12. Thus, tube 13 is slidably supported within tube 12 by the inner annular bearing surface of tube 12 and the outer annular bearing surface of tube 13 each sliding on the other tube.

A sleeve 28 mounted on the lower end of tube 13 above rigid lower end 24 is provided with a plurality of extending contact fingers 30 which project outward into electrical contact with inner surface 26 of tube 12.

Sleeve 28 with fingers 30 may be unnecessary in some antennas according to this invention due to the possibility of good alternative electrical contact between the antenna tubes as described at a later point in this specification.

At the top of sleeve 28 or, in the absence of sleeve 28, at a point axially separated from rigid lower end 24, tube 13 is provided with an outer circumferential shoulder 32. Mounted on tube 13 above an adjacent shoulder 32 is a circumferential sealing element 33 which may take the form, as in FIG. 2, of a flexible O-ring but could alternatively be some other form of compressible substance applied circumferentially around tube 13 on the upper side of shoulder 32 so as to be compressed between shoulder 32 and the inward bent upper end 20 of tube 12 when the antenna is fully extended. Sealing element 33 thus seals the opening at the top of tube 12 while the antenna is in its extended position and may further, if provided with electrical conduction capability, provide electrical connection between the tubes for redundancy or for the elimination of sleeve 28 with fingers 30.

The operations of extension and retraction of antenna 10 are expected to occur only infrequently; and their short duration, together with the small clearance between inner annular bearing surface 21 and tube 13, ensure that very little, if any, water will enter the interior of antenna 10 during such operations. A cap 35 may be provided on the top of the innermost element 15 to axially engage sealing means on the top of tube 11 or the vehicle body surface and thus prevent entry of water into the antenna while the antenna is in its retracted condition.

The outer diameter of sealing element 33 and shoulder 32 are less than the diameter of inner surface 26 of tube 12; and, therefore, there is no sliding contact or friction due to sealing member 33 or shoulder 32 during the operations of extension and retraction of antenna 10. This, combined with the good bearing surfaces of the inner and outer annular bearing surfaces 21 and 25, minimize the total friction involved in extension and retraction of antenna 10 and thus reduce the tendency to bind in a partially extended position; and this helps produce smooth and dependable operation of the antenna.

The preceding describes only one possible embodiment of this invention. Therefore, it is understood that other embodiments will occur to those skilled in the art and that this invention should be limited only by the claim which follows.

The embodiments of the invention in which an exclusive property or privilege is claimed are defined as follows:

1. A telescoping, multi-tube, vehicle radio antenna adapted for power extension and retraction, comprising, in combination:

an outer metallic antenna tube having an inward bent upper end defining an inner annular bearing surface;

an inner metallic cylindrical antenna member in telescoping relationship within the tube, the element having an expanded diameter rigid lower end defining an outer annular bearing surface and being slidably supported in the tube at the axially separated inner and outer annular bearing surfaces, the cylindrical antenna member further having outer circumferential shoulder means spaced upwardly from the lower end; and a circumferential sealing element fixed to the cylindrical member in a position abutting the upper side of the outer circumferential shoulder means, said sealing element being compressible between the outer circumferential shoulder means and the inward bent upper end of the tube when the antenna is extended to prevent entry of water into the tube but being smaller in outer diameter than the inner diameter of the remainder of the tube so as to contribute no additional sliding friction or tendency to bind between the tube and cylindrical member during antenna extension and retraction.

* * * * *